US006584879B2

(12) United States Patent
Gorman

(10) Patent No.: US 6,584,879 B2
(45) Date of Patent: Jul. 1, 2003

(54) SYSTEM AND METHOD FOR DISABLING TIME CRITICAL TARGETS

(75) Inventor: Richard Gorman, Potomac, MD (US)

(73) Assignee: Northrop Grumman Corporation, Redondo Beach, CA (US)

( * ) Notice: Subject to any disclaimer, the term of this patent is extended or adjusted under 35 U.S.C. 154(b) by 0 days.

(21) Appl. No.: 10/001,533

(22) Filed: Nov. 14, 2001

(65) Prior Publication Data

US 2003/0089219 A1 May 15, 2003

(51) Int. Cl.[7] ..... B64D 1/04
(52) U.S. Cl. ..... 89/1.11
(58) Field of Search ..... 89/1.11, 1.816; 244/3.15; 102/382

(56) References Cited

U.S. PATENT DOCUMENTS 1,235,637 A * 8/1917 Barlow ..... 102/258
1,239,134 A * 9/1917 Steel ..... 102/404
3,403,624 A * 10/1968 Fosler et al. ..... 102/404
3,602,471 A * 8/1971 Reed, III ..... 248/156
3,921,528 A * 11/1975 Faulstich et al. ..... 102/404
4,715,283 A * 12/1987 Yengst ..... 102/384
4,901,644 A * 2/1990 Nevins et al. ..... 102/293
4,969,398 A * 11/1990 Lundwall ..... 102/293
5,017,047 A * 5/1991 Myles et al. ..... 124/56
5,022,470 A * 6/1991 Andersen et al. ..... 175/14
5,053,622 A * 10/1991 Kessler ..... 250/290
5,198,607 A * 3/1993 Livingston et al. ..... 89/1.11
5,273,236 A * 12/1993 Wootton et al. ..... 244/3.11
5,343,809 A * 9/1994 Wennberg et al. ..... 102/371
5,458,041 A * 10/1995 Sun et al. ..... 244/3.11
5,464,174 A * 11/1995 Laures ..... 244/3.11
5,497,705 A * 3/1996 Bredy et al. ..... 102/427
5,524,524 A * 6/1996 Richards et al. ..... 102/310
6,014,932 A * 1/2000 Mardirossian ..... 102/200
6,164,179 A * 12/2000 Buffman ..... 114/316
6,209,820 B1 * 4/2001 Golan et al. ..... 244/3.1

* cited by examiner

*Primary Examiner*—Charles T. Jordan
(74) *Attorney, Agent, or Firm*—Antonelli, Terry, Stout & Kraus LLP

(57) ABSTRACT

The present invention is a method and system for disabling time critical and moving targets and an air deployed guided missile launcher. A system for disabling a time critical target at a site within a geographical area in accordance with the invention includes a plurality of spaced apart mostly buried missile launchers located within or adjacent to the geographical area with each spaced apart mostly buried mobile missile launcher containing a guided missile, any site within the geographical area being located at a distance from at least one spaced apart missile launcher not more than a maximum distance of travel of a guided missile launched from at least one of the spaced apart missile launchers to the site, the time of travel of a missile from the missile launcher to the site requiring less time than a maximum time required to enable the time critical target at the site.

15 Claims, 9 Drawing Sheets

SYSTEM AND METHOD FOR DISABLING TIME CRITICAL TARGETS

BACKGROUND OF THE INVENTION

1. Field of the Invention

The present invention relates to systems and methods for disabling time critical and moving targets.

2. Description of the Prior Art

In order to stop enemy forces from launching ballistic missiles from mobile missile launchers (TELs), it is necessary to disable the TEL before a launch is completed. The launch sequence for launching a ballistic missile from a TEL is less than ten minutes and may be substantially shortened in the future.

The time required for an airplane to travel to a target, such as a TEL, from a loitering patrol may be 15 minutes. Under the best circumstances, a TEL may be attacked by a loitering patrol in about 30 minutes from the time that sensors following the TEL, such as from the air or on the ground, have detected stopping of the TEL to launch a ballistic missile. In practice, because of the large time required to reach the TEL with loitering patrolling aircraft, the ballistic missile associated with the TEL will have been launched 20 minutes before the shortest time possible for a loitering patrolling aircraft to reach the site where the TEL is positioned. In fact, most often a TEL will have launched a ballistic missile and exited the area of a ballistic missile launch long before a loitering patrolling aircraft could reach the launch site. In the 1990 "Gulf War", not one TEL was successfully attacked before, during or after launching a ballistic missile.

Furthermore, short range (1,000 km) solid fuel missiles having a great acceleration at launch, may become widely available. Short range solid fuel missiles reach burnout very quickly and have a short period of vulnerability during a booster phase before burnout to a first stage active missile defense designed to hit the booster phase with a counter-missile.

A successful TEL defense must be predicated upon greatly reducing the time required to intercept the TEL after detection thereof. The interception of a TEL should occur in a time window within five minutes of stopping of the TEL to prepare for a launch.

FIG. 1 illustrates a block diagram of a prior art rocket-boosted five-inch naval shell known as the EX 171 ERGM (hereinafter ERGM). The ERGM 10 is comprised of a guidance and navigation section 12, a control section 14 which controls canards 16 to control flight, a group of submunitions 18 which are deployed at the attack site, a solid fuel rocket motor 22 and a group of fins 24 which are fixedly deployed upon firing. A safe and arm device 26 performs the function of arming the submunitions.

The ERGM 10 is fired from a five-inch gun as illustrated in FIG. 2. After the initial rapid acceleration produced by firing from the gun, which subjects the ERGM 10 to high "G" forces, such as 12,000 (G)s, the canards 16 and fins 24 deploy and the electrical battery therein is activated. The rocket motor 22 is then ignited which propels the ERGM 10 to what may be a substantial-distance of many miles to target 44. The flight may be in excess of 50 miles under guidance control by the combination of a GPS and inertial guidance provided by the guidance and navigation section 12. The guidance and navigation system 12 steers the missile to a position above the target 44 at which the submunitions 18 are dispensed from an altitude, such as 250–400 meters, within a cluster 19. The cluster 19 containing the submunitions 18, strikes the vicinity of the target 44.

As illustrated in FIG. 2, after the initial firing of the five-inch shell, there is a motor burn period 40 during which the ERGM 10 accelerates. Beginning at substantially the same time as the motor burn 40, the guidance and navigation section 12 acquires, during a GPS acquisition window period 42, communications with a GPS satellite (not illustrated) to determine the position thereof which enables control of the canards 16 by the navigation and guidance section 12 to guide the ERGM to the coordinates of the target 44 at which the submunitions 18 are dispensed in cluster 19.

FIG. 3 illustrates the prior art air dropped advance remote ground unattended sensor (ARGUS) 110. The sharp tip 113 is guided by control surfaces 114 to embed in the ground 112 after free fall after dropping from an airplane. The ARGUS 110 contains microphones (not illustrated) which detect the acoustic signature of ground vehicles moving in the vicinity thereof. The control surfaces 114 stop the rear cap 111 from penetrating below the ground 112. The radio 118 and antenna 116 uplinks to a GPS satellite the coordinates of the ARGUS and any sensed ground vibrations produced by movement of vehicles in the vicinity thereof.

The ARGUS 110 has a diameter of five inches, a weight of 83.2 lbs. and is deployed from an aircraft with a free fall terminal velocity of about 243 feet per second. The ARGUS 110 has a geodynamic diameter of four inches and geodynamic ballistic coefficient of 916 psf. The ARGUS 110 may penetrate in the ground up to 100 inches. During penetration into the ground 112, the deceleration forces may be 129 (G)s with 340 "G"s being a maximum. High energy density lithium primary batteries (not illustrated) are contained in the ARGUS 110 and have a running life of at least three months. The batteries provide electrical power for activation of the GPS radio 118 which provides communications 120 to a satellite (not illustrated) which may function as a command center or a relay to a command center. Alternatively, the communications 120 may be linked to an unoccupied air vehicle (UAV).

Additionally, a wide area munition (WAM) has been developed for defending against track and other wheeled ground vehicles. A small lightweight platform, which may be dropped from a vehicle or from the air, permits deployment in virtually any territory including flat or sloped surfaces. The WAM may be activated manually to permit personnel to move from the area prior to arming or activated by remote control.

Seismic and acoustic sensors in a WAM are activated, after deployment, which monitor ground and environmental conditions to detect and classify tracked and wheeled military vehicles. Upon detection of a target vehicle, a WAM tracks the target vehicle and launches a sensor fused sublet over the target vehicle. An infrared sensor on the sublet detects the target vehicle and initiates an explosively formed penetrator (EFP) warhead to defeat the top vehicle armor. The sublet has a range of up to 100 meters from the initial ground deployed position.

Electronic communication capability may connect WAMs into a network to provide communications with a control center. The identification of characteristics of oncoming enemy vehicles, including vehicle type, geographic coordinates, speed and heading may be detected by the control center.

Air deliverable acoustic sensors (ADAS) are passive non-line of sight acoustic sensors for detecting, classifying and tracking ground and air vehicles at extended ranges. ADAS may be hand deployed, remotely by truck, helicopter or other vehicle. An ADAS locates and classifies the ground vehicles, helicopters, artillery, and rocket launchers at extended range.

SUMMARY OF THE INVENTION

The present invention is a method and system for disabling a time critical target at a site within a geographical area, a guided missile launch assembly, and a method and system for disabling a moving target within a geographical area. The invention utilizes a combination of sensors, deployed within or adjacent to the geographical area or which are airborne, to monitor the geographical area to determine if a time critical target or a moving target is present therein. Spaced apart air deployed missile launchers are located within or adjacent to the geographic area. Each missile launcher contains a guided missile. The guided missile launchers are sufficiently close to any site within the geographical area at which a time critical target or a moving target is located or may be located that upon detection of the target by the sensor(s), the guided missile from at least one guided missile launcher may be launched sufficiently quickly to prevent the time critical target or moving target from being enabled to complete a mission such as launching a ballistic missile and/or moving from the site to prevent disablement thereof. Each missile launcher in most types of ground almost completely buries itself in the earth on impact so as to be undetectable.

Any target site within the geographical area is located at a distance from at least one missile launcher within or adjacent to the geographical area which is not more than a maximum distance of travel of a guided missile launched from one of the missile launchers to the site. The maximum distance of travel requires less time than a minimum time available to successfully enable the time critical target at the site to perform a mission such as launching a guided missile.

When a moving target is to be disabled within a geographical area, at least one and preferably a plurality of spaced apart missile launchers located within or adjacent to the geographical area are launched to a projected site at which the moving target is intercepted. The moving target within the geographical area is located at a distance from at least one spaced apart missile launcher which is not more than a maximum distance of travel thereof. The at least one guided missile is launched from the at least one spaced apart missile launcher to a calculated position within the geographic area at which at least one guided missile is to fly to disable the moving target. At least one sensor, which may be a ground deployed sensor, a spacecraft borne sensor or an airborne detector, detects the moving target within the geographical area. At least one processor, which may be located at the control center, calculates a site to which at least one guided missile is commanded to fly to intercept and disable the moving target. The command center is linked to the at least one sensor and to the plurality of missile launchers which commands launching of at least one guided missile, and preferably a plurality of guided missiles, from missile launchers to disable the moving target at the site calculated by the at least one processor in response to the detecting of the moving target by the at least one sensor.

The invention may utilize the prior art ERGM as part of an air deployed guided missile launcher assembly. A sleeve containing a guided missile such as, but not limited to, the ERGM, is deployed from the air. The sleeve has a pointed end which penetrates the ground upon impact. Because the launcher is embedded in the earth, it is not detectable. In one preferred embodiment, an outer sleeve and an inner sleeve are utilized in the guided missile launcher. The inner sleeve is mounted to telescope relative to the outer sleeve and telescopes upon impact with the ground so that the pointed end of the inner sleeve containing the missile penetrates into the ground.

The prior art ERGM may be modified to include a transceiver which communicates to a satellite or airframe the GPS coordinates of the deployed guided missile launcher assembly and receives commands to launch the guided missile therein from a command center. A battery powered unit maintains the transceiver and the missile in an electrically powered status when embedded in the ground. A fin assembly is located proximate to the transceiver. The fin assembly may act to stop penetration of the outer sleeve into the ground to prevent burying of the transceiver which could interfere with or prevent communications with satellites or airframes. The outer sleeve also provides a guidance path for launching of the guided missile.

The present invention provides rapid attack of time critical targets and moving targets. The guided missiles may be of a short range design to reduce expense and are smaller than conventional guided missile launches which are located on friendly territory. The smaller size and weight of guided missile launchers in accordance with the present invention facilitates airplane deployment. A large number of guided missile launchers may be deployed by a single airplane flight. The use of GPS coordinates to signal, via an uplink to a satellite, the position of each active guided missile launcher, permits the deployment pattern to be of low precision and imprecise since the position of each successfully deployed guided missile launcher is relayed by aerial communication relays, such as in UAVs or satellites and relayed to the control center. The relatively short range between any possible target and the array of guided missile launchers of the present invention, is less than the maximum range of the guided missiles within the guided missile launchers. The flight time required to fly the maximum range is less than a minimum time available to successfully enable the time critical target at the site or the time required to fly to the site of disabling the moving target.

The GPS link between the airborne guided missiles with GPS satellites permits updating of flight position during flight. The command center can transmit updates of the target rendezvous point via the satellite communications link. This permits the missile to "follow" the target. The satellite radio uplinked GPS coordinates permits a command center to know where operational guided missile launchers are located to permit complete coverage of the geographic area. If, at any time, part of a geographic area in which coverage of guided missile launchers is desired is not successfully covered, additional air deployed ground missile launchers may be dropped to complete coverage.

The relatively small expense of the guided missile launchers of the present invention makes it acceptable for a significant fraction thereof to not be successfully deployed as a consequence of hitting ground surfaces which are too hard or too soft.

A combination of ground sensors such as, but not limited to, the prior art ARGUS or aerial reconnaissance using known radars or other detection technologies from moving platforms, such as in airframes, UAVs or satellites may be used in accordance with the invention.

The present invention permits a guided missile launched from a guided missile launcher in accordance with the invention to fly to a TEL or other target within 120 seconds of launch time. This short time permits destruction of an offensive ballistic missile before launch thereof from a TEL.

A system for disabling a time critical target at a site within a geographical area in accordance with the invention including a plurality of spaced apart missile launchers located within or adjacent to the geographical area with each spaced apart mobile missile launcher containing a guided missile, any site within the geographical area being located at a distance from at least one spaced apart missile launcher not more than a maximum distance of travel of a guided missile launched from at least one of the spaced apart missile launchers to the site, the time of travel of a missile from the missile launcher to the site requiring less time than a minimum time required to enable the time critical target at the site. The spaced apart missile launchers may each comprise a sleeve and a pointed end penetrated into ground at a site, the sleeve at least partially penetrating into the ground and containing the guided missile to be launched from the missile launcher. The system may include at least one sensor, the at least one sensor detecting a time critical target at at least one site within the geographical area; and a command center, linked to the at least one sensor and to the plurality of spaced apart missile launchers, which commands launching of a guided missile from at least one of the spaced apart missile launchers to disable at least one time critical target at at least one site detected by the at least one sensor. The spaced apart missile launchers may be located in a geometric pattern within the geographical area. The geometric pattern may be a plurality of adjacent hexagons. The missile launchers located within the geographical area may comprise a transceiver with at least an antenna disposed above the ground which transmits a radio signal indicating coordinates thereof within the geographical area and which receives commands for launching the guided missile to disable a time critical target at one site; and the guided missile contained in the missile launchers may contain a guidance system which controls flight of the guided missiles and which is in radio contact with the transceiver or a command center to control flight thereof. An unmanned aircraft may illuminate the time critical target with a beam of light; and the guided missile may include a sensor which senses reflection of the beam of light from the time critical target and may guide, in response to the sensed reflection of the beam of light, the missile during flight to the time critical target. The spaced apart missile launchers may each comprise an outer sleeve and an inner sleeve. The inner sleeve may contain the guided missile and may telescope relative to the outer sleeve into the ground and contain a battery power unit which maintains the transceiver and the missile in an electrically powered status when embedded in ground. The outer sleeve may have a fin assembly located proximate to the transceiver; and both the inner and outer sleeves may be a debris-free guidance path for launching of the guided missile. The time critical target may be a mobile ground missile launcher. The at least one sensor may be in the ground within the geographical area or in flight.

An air deployed guided missile assembly in accordance with the invention includes a sleeve which is deployed from the air, the sleeve including a pointed end which penetrates the ground upon impact with the ground; and a guided missile contained within the sleeve with the sleeve guiding and providing a debris-free path for the guided missile during launch. The assembly may include an outer sleeve and an inner sleeve containing the guided missile which is mounted to telescope relative to the outer sleeve and which telescopes upon impact with a ground contact point when deployed from the air. A transceiver with at least an antenna may be disposed above the ground after impact which transmits a radio signal indicating coordinates of a location of the guided missile within a geographical area of deployment and which receives commands for launching the guided missile to fly to a site; and wherein the guided missile has a guidance system which controls flight of the guided missile and which is in radio contact with the transceiver or a command center to control flight thereof. The inner sleeve may telescope relative to the outer sleeve into the ground and contain a battery power unit which maintains the transceiver and the missile in an electrically powered status when embedded in the ground. The outer sleeve may have a fin assembly located proximate to the transceiver when the pointed end penetrates into the ground; and both the inner and outer sleeves may be a guidance and debris-free path for launching of the missile.

A system for disabling a moving target within a geographical area includes a plurality of spaced apart missile launchers located within or adjacent to the geographical area with each spaced apart mobile missile launcher containing a guided missile, any moving target within the geographical area being located at a distance from at least one spaced apart missile launcher not more than a maximum distance of travel of a guided missile launched from at least one of the spaced apart missile launchers to a calculated position within the geographical area at which at least one guided missile is to fly to disable the moving target; at least one sensor, the at least one sensor detecting the moving target within the geographical area; at least one processor for calculation of a site to which at least one guided missile is commanded to fly to disable the moving target; and a command center, linked to the at least one sensor and to the plurality of spaced apart missile launchers, which commands launching of a guided missile from at least one of the spaced apart missile launchers to disable the moving target at a site calculated by the at least one processor in response to the detected moving target detected by the at least one sensor. An unmanned aircraft may illuminate the time critical target with a beam of light; and the guided missile may include a sensor which senses reflection of the beam of light from the time critical target and may guide, in response to the sensed reflection of the beam of light, the missile during flight to the time critical target. The spaced apart missile launchers may each comprise a sleeve and a pointed end penetrated into ground at a site, the sleeve at least partially penetrating into the ground and containing the guided missile to be launched from the missile launcher. The spaced apart missile launchers may be located in a geometric pattern within the geographical area. The geometric pattern may be a plurality adjacent hexagons. The missile launchers located within the geographical area may comprise a transceiver with at least an antenna disposed above the ground which transmits a radio signal indicating coordinates thereof within the geographical area and which receives commands for launching the guided missile to disable the moving target; and the guided missile contained in the missile launchers may contain a guidance system which controls flight of the guided missiles and which is in radio contact with the transceiver or the command center to control flight thereof. The spaced apart missile launchers may each comprise an outer sleeve and an inner sleeve; the inner sleeve containing the guided missile and telescoping relative to the outer sleeve into the ground and containing a battery power unit which maintains the transceiver and the missile in an electrically powered status when embedded in ground; the outer sleeve may have a fin assembly located proximate to the transceiver; and both the inner and outer sleeves may be a guidance and debris-free path for launching of the guided missile.

A method for disabling a time critical target at a site within a geographical area in accordance with the invention includes air deploying a plurality of spaced apart missile launchers located within or adjacent to the geographical area with each spaced apart mobile missile launcher containing a guided missile, any site within the geographical area being located at a distance from at least one spaced apart missile launcher not more than a maximum distance of travel of a guided missile launched from at least one of the spaced apart missile launchers to the site, the time of travel of a missile from the missile launcher requiring less time than a minimum time required to successfully enable the time critical target at the site; detecting a time critical target within the geographical area; and launching at least one guided missile from a guided missile launcher and guiding the at least one guided missile to the site to disable the time critical target.

A method for disabling a moving target within a geographical area in accordance with the invention includes air deploying a plurality of spaced apart missile launchers located within or adjacent to the geographical area with each spaced apart mobile missile launcher containing a guided missile, any moving target within the geographical area being located at a distance from at least one spaced apart missile launcher not more than a maximum distance of travel of a guided missile launched from at least one of the spaced apart missile launchers to fly to the calculated position within the geographical area at which at least one guided missile is to fly to disable the moving target; providing at least one sensor to detect the moving target; detecting with the at least one sensor the moving target within the geographical area; providing a command center, linked to the at least one sensor and to the plurality of spaced apart missile launchers; using at least one processor to calculate a site to which the moving target is calculated to be moving and to which at least one guided missile is commanded to fly to disable the moving target; and commanding, with the command center, launching of at least one guided missile from at least one of the spaced apart missile launchers which is guided to fly to the site calculated by the at least one processor in response to the detection of the moving target to disable the moving target at the site. An unmanned aircraft may be provided which illuminates the time critical target with a beam of light; and the guided missile may be provided with a sensor which may sense reflection of the beam of light from the time critical target and guide, in response to the sensed reflection of the beam of light, the missile during flight to the time critical target.

BRIEF DESCRIPTION OF THE DRAWINGS

Like reference numerals identify like parts throughout the drawings.

DESCRIPTION OF THE PREFERRED EMBODIMENTS

Figure 4:
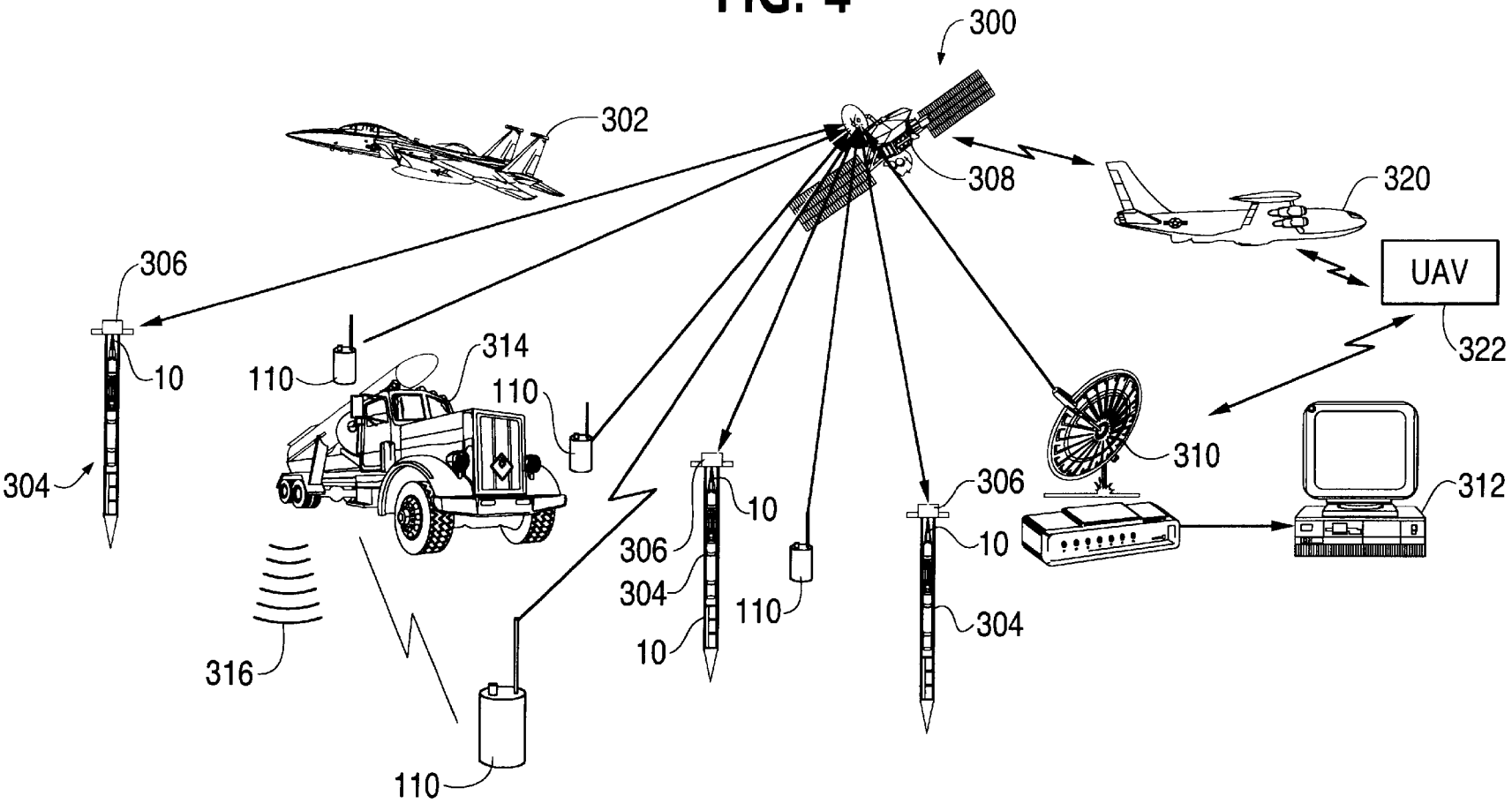
FIG. 4 illustrates a diagram of a system implementation in accordance with the present invention which may be used to disable time critical and moving targets.

FIG. 4 illustrates a system 300 for disabling a time critical target at a site within the geographical area or a moving target within a geographical area in accordance with the present invention. The system 300 is low in cost and easy to deploy. With the invention, an array of air deployed sensors 110, embedded in the ground or in airborne sensors which use radar, optics, or other technologies, detect the time critical or moving targets of interest within a geographical area. An array of guided missile launchers 304, deployed in accordance with the present invention, are low in cost and embedded in the earth. The deployment of the missile launchers by high speed impact from the air buries the missiles so as to conceal them. Missile concealment after deployment prevents quick disablement. As a result, missile launchers may remain in an active status for many months, (e.g. 3 months) or until batteries therein discharge, which permits the destruction of time critical targets over an extended period of time after deployment. A ground penetrated deployed guided missile 10 contained within a guided missile launcher is operated in a battery powered "watch" status for an extended period of time. Each guided missile 10 may be selectively fired on command from a command center 312 after the detection of a time critical or a moving target within the geographical area. The ground embedded sensors 110 alone or in combination with airborne sensors in a manned aircraft 320 and in an unmanned aerial vehicle (UAV) 322 and the guided missile launchers 304 in accordance with the present invention have sufficient density and are deployed close enough to any potential time critical or moving target within the geographical area to permit effective detection and disablement thereof. In the case of time critical targets, at least one spaced apart guided missile launcher 304 is located not more than a maximum distance of travel of a guided missile launched to the time critical target site and the distance of travel of the guided missile requires less time than a minimum time required to enable the time critical target at the site. In the case of a moving target, after sensing thereof by the sensors, a position at which interception is to occur is calculated by at least one processor, such as at the command center 312, which is a distance from at least one spaced apart guided missile launcher 304 which is not more than a maximum distance of travel of a guided missile 10 to the calculated position.

Figure 1:
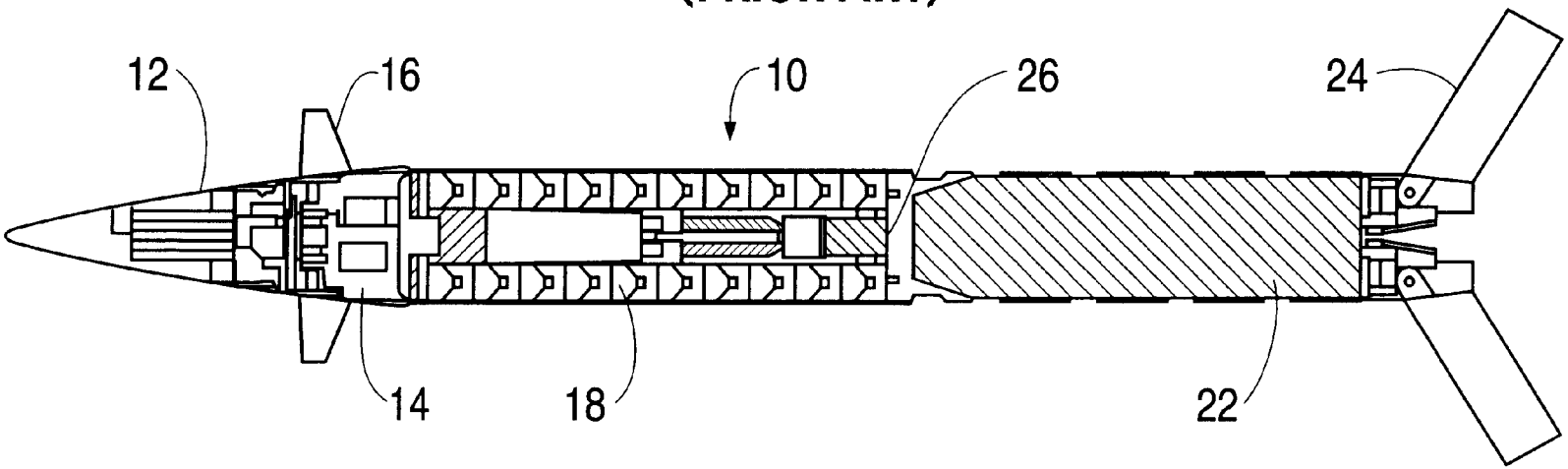
FIG. 1 (PRIOR ART)
FIG. 1 illustrates a diagram of the prior art ERGM guided missile which may be utilized as a preferred guided missile in a method and system for disabling a time critical target or moving target within a geographical area and in an air deployed guided missile launcher in accordance with the present invention.
Figure 2:
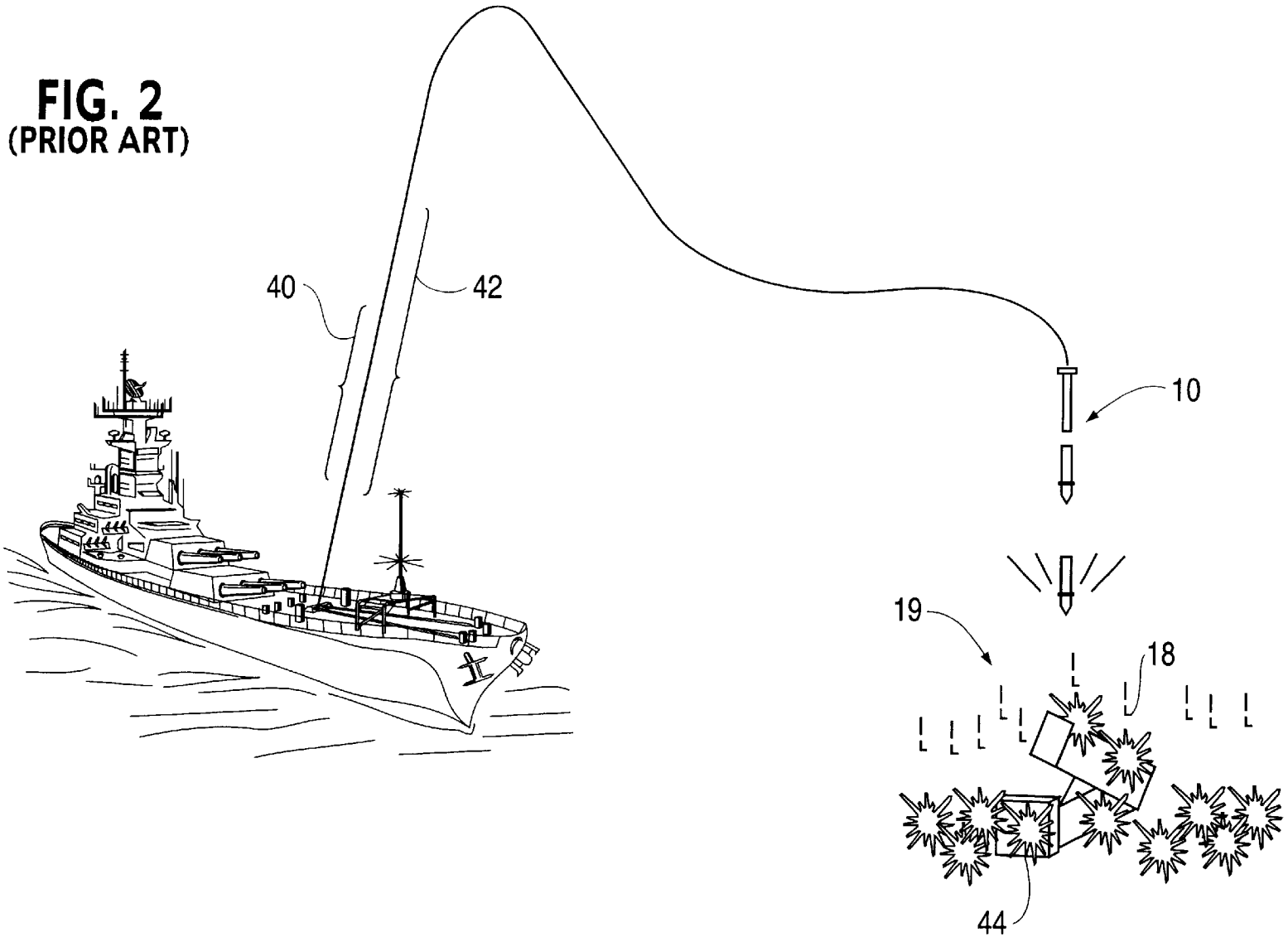
FIG. 2 (PRIOR ART)
FIG. 2 illustrates the use of the prior art guided missile of FIG. 1.
Figure 3:
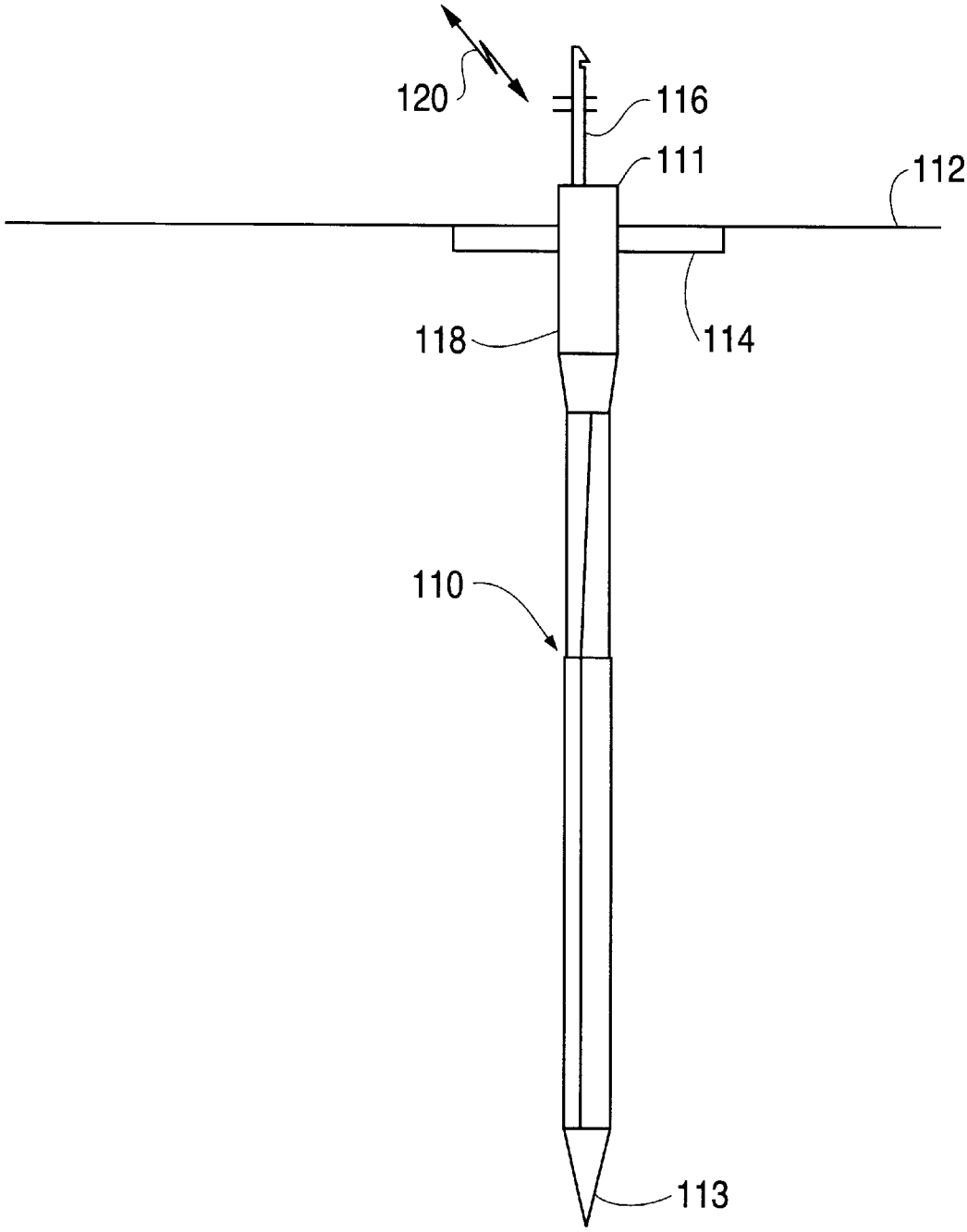
FIG. 3 (PRIOR ART)
FIG. 3 illustrates a diagram of a prior art ARGUS remote ground unattended sensor which may be utilized as a ground sensor in accordance with the present invention.

The system 300 may use conventional components, such as the prior art guided missile described above in conjunction with FIGS. 1 and 2 and ground sensors in accordance with FIG. 3 as described above. However, it should be understood that the present invention is not limited to the use of the guided missiles of FIGS. 1 and 2 and the ground deployed sensors of FIG. 3. The guided missiles of FIGS. 1 and 2 are modified as described below to be contained within at least one sleeve having a pointed end which penetrates into the ground when deployed from an airframe 302. The guided missile launcher 304 is described in more detail below in conjunction with FIGS. 6–8. When deployed, a radio transceiver 306 transmits the GPS coordinates of the missile launcher 304 to a satellite 308 which relays the coordinates via a ground station 310 to a command center 312. The radio transceiver 306 is linked to the command center to provide the operational status of the missile and the coordinates thereof. The antenna associated with the radio transceiver 306 may be designed to provide directional transmission to the satellite 308, such as, but not limited to, a cone, to make it difficult to detect the deployed missile launchers 304 from the ground. A series of the ground sensors 110 are also deployed by aircraft 302. Each sensor 110, as described above in conjunction with FIG. 3, contains a series of microphones which detects motion and stopping of a time critical target 314. The motion and stopping of a time critical target, such as a TEL, produces a characteristic vibration pattern 316 which is picked up by one or more proximate sensors 110. The particular vibrational pattern 316 of the moving and stopping of a time critical target, is identifiable by software analysis at the command center 312, which may be located anywhere in the system 300, such as on the ground or in an airframe 320. A series of UAVs 322 and the aircraft 320 containing radars or other airborne or satellite based sensors may be used with the ground sensors 110 for detecting time critical targets 314 located at sites which are sufficiently close to one or more missile launchers 304, such that the time required to fly to each site (which is closer to the missile launchers 304 than the maximum range of the missiles therein) is less than a minimum time required, for example, to enable the time critical target 314 at the site, such as enabling of launching a guided missile therefrom.

The sensors in UAV 322 may identify the position of the time critical target 314, instead of exclusively using GPS coordinates, by illuminating the target area of the time critical target with a laser beam. The time critical target 314 may be correctly identified even if the GPS coordinates that were transmitted from the UAU 322 to the command center 312 and then to the guided missile launcher(s) 304 are off by at least 50 meters. A laser reflection sensor 605, as illustrated generally in FIGS. 6–8, associated with the tip 604 or another part of the guided missile corrects the trajectory of the missile during flight to the time critical target 314. Laser guiding of missiles is known as, for example, used in the Predator missile as reported in the Feb. 21, 2001 article in the Aerospace Daily. The sensor 605 may be the "Kosovo ball" referred to in the preceding article which is incorporated hereinafter by reference in its entirety.

The guided missiles 10 within the air deployed missile launchers 304, because of a high density deployment in or adjacent to the geographical area which may contain a time critical or mobile targets therein, provide a swift response to the detection of a time critical or moving target sufficient to stop launching of a guided missile or intercept the moving target. A response within the minimum time window is extremely important to disable targets, such as time critical targets 314, which may be capable of launching a guided missile 10 in times as short as two minutes. Furthermore, because of close and dense deployment of missile launchers 304 in or adjacent to any site within the geographical area, the guided missiles 10 therein may be a short range design which is less expensive and smaller in size than conventional ground deployed guided missile launchers which are located remote from targets. This facilitates effective deployment of the guided missile launchers 304 and the sensors 110 by aircraft 302 because great care and precise location thereof is not required.

Furthermore, the deployment pattern does not have to be precise. The GPS transmitter 306 within the guided missile launcher 304 provides the control system 312 with accurate position coordinates of all active mobile missile launchers. The GPS coordinates of each operational mobile missile launcher 304, over a period of time, may be averaged out by the command center 312 to provide very precise location of the individual guided missile launchers in the ground.

When a relatively high density of deployment of the guided missile launchers 304 is utilized, it is acceptable that a significant fraction thereof are destroyed during deployment from the air, such as caused by hitting ground, which is either too hard or too soft. Furthermore, after an initial deployment of the guided missile launchers 304, the command center 312 will know, from monitoring of all of the uplinked GPS coordinates received from the deployed missile launchers, those areas within the geographical area which aren't covered with a sufficient density of successfully deployed guided missile launchers and sensors 110 (ground deployed sensors are desirable, but not required). This permits additional deployment to be correctly made to provide a sufficient density of guided missile launchers 304 and sensors 110 throughout the geographical area which is to be covered. Additionally, because of the relative small expense of the guided missiles 10 within the guided missile launchers 304, which may be based upon off the shelf components, and the small size and weight thereof, the deployment may be of sufficient density that groups of guided missiles may be launched to fly to the vicinity of the calculated position at which a moving target is to be intercepted thereby making it possible, because of a relatively large number of missiles being within the vicinity of the moving target, that the likelihood of disablement thereof is high.

Figure 5:
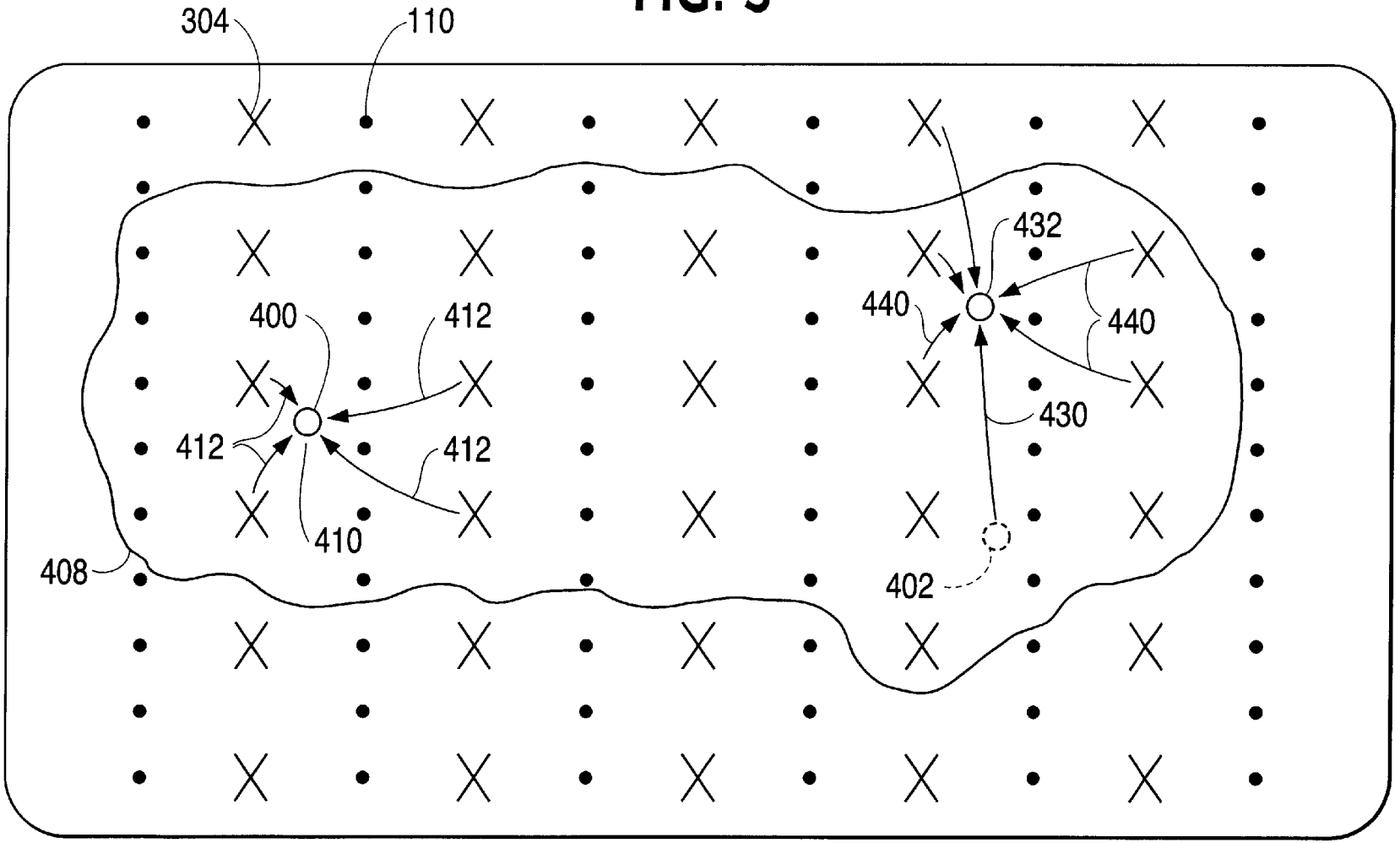
FIG. 5 illustrates a conceptual diagram of the process of disabling a time critical and a moving target in accordance with the present invention.

FIG. 5 illustrates a methodology of how a time critical target 400 and a moving target 402 may be disabled with the system 300 of FIG. 4. Individual guided missile launchers 304 are illustrated as being air deployed in a geometric pattern which, in accordance with the invention, may be varied to be either regular, such as in FIGS. 5 and 9, or arbitrary. As illustrated, the regular deployment of guided missile launchers 304 provides uniform spacing within the geographical area 408 in which a time critical target 400 or moving target 402 is to be disabled. The regularly spaced array of air deployed ground sensors 110 monitors the geographical area of interest. It should be understood that the present invention is not limited to any particular or regular deployment of the guided missile launchers 304 or the ground sensors 110. Furthermore, the ground sensors 110 are linked via an uplink to satellite 308 and then ultimately to the operation center 312 to provide vibrations or acoustic signals 316 and the GPS position thereof. However, the methodology of FIG. 5 may be practiced with the addition of airborne or satellite deployed sensors or the replacement of the ground sensors 110 thereby.

As illustrated, both the ground embedded guided missile launchers 304 and the ground sensors 110 are deployed from the air. Upon striking the ground, the antennas thereof are above the ground to permit uplinking to the satellite 308, including GPS coordinates, as described in conjunction with FIG. 4.

While the present invention permits the disabling of a time critical target 400 or a moving target 402 with as little as one guided missile 10 within a guided missile launcher 304, in practice, because of the relative low cost and the ease of deployment of both the ground sensors 110 and the missile launchers, the command center 312 may command launching of a group of guided missiles from guided missile launchers 304 which are adjacent to and sufficiently close in air travel time to the time critical target 400 to ensure disablement thereof in less than the minimum time required for enablement.

In the case of disabling a time critical target 400, the ground sensors 110 proximate to the site 410 of the time critical target detect an acoustic or seismic signature thereof, such as the vibrations 316 of by moving and stopping of a TEL, such as the TEL 314 of FIG. 4, which permits the command center 312 to rapidly analyze the nature of the acoustic vibrations and further, because of the sensing from multiple sensors 110 to determine precisely enough the coordinates to which the missiles 10 of the guided missile launchers 110 are commanded to fly to achieve disablement. Similarly, the target may be located from the air or from satellite sensors. As illustrated in FIG. 5, the time critical target 400 is attacked by guided missiles launched four adjacent guided missile launchers 304 which are directed to fly along flight paths 412 to site 410 within the geographical area 408. The site 410 is located at a distance from the four guided missile launchers 304 which is not more than a maximum distance of travel of a guided missile launched from the four spaced apart guided missile launchers to the site. The maximum distance of travel of the guided missiles 10 requires less time to cover than a minimum time required to successfully enable the time critical target 400. The time to travel the path of travel 412 of each guided missile to the site 410 takes less time than the minimum time required to successfully enable the time critical target. It may be that guided missile launchers 304 located at greater distances than the above described four guided missile launchers are chosen to launch additional missiles to insure disablement of the time critical target 400. The closer the individual guided missile launchers 304 are located to the time critical target, the more likely that a missile launch will be successful in disabling the time critical target such as mobile missile launcher 314 of FIG. 4.

The interception of moving target 402 requires information, from the array of sensors 410 alone or in combination with airborne or satellite-based sensors or only from airborne or satellite-based sensors, sufficient to calculate the vector 430 representing the direction and speed of travel thereof. Once the vector 430 has been calculated by at least one processor located at the command center 312 or elsewhere, the launching of missiles 10 from deployed guided missile launchers 304 is analogous to that of disabling the time critical target except that the site of the interception 432 is not the current location of the moving target 402 at the time of launch of the individual missiles 10 from the guided missile launchers. The path 440 of the guided missiles may be updated during flight in view of the communication uplink from the flying missiles and the GPS/inertial guidance system therein based upon a recalculation of the vector 430. When a moving target 402 is being intercepted, it may be desirable to launch even a higher number of guided missiles 10 than the number utilized to disable a time critical site 400 in view of there being no way to precisely ascertain from the calculation of vector 430 that the moving target 402 will continue to move along its projected vector path 430 even assuming the updating of the coordinates of the moving target during flight of the missiles as the result of continued information be received from the sensors 110 or airborne sensors. Therefore, covering a larger site 432 with a larger number of guided missiles ensures a higher likelihood of successfully disabling the moving target even if during the time of flight variation in the vector path 430 occurs because of change in speed or direction.

Figure 6:
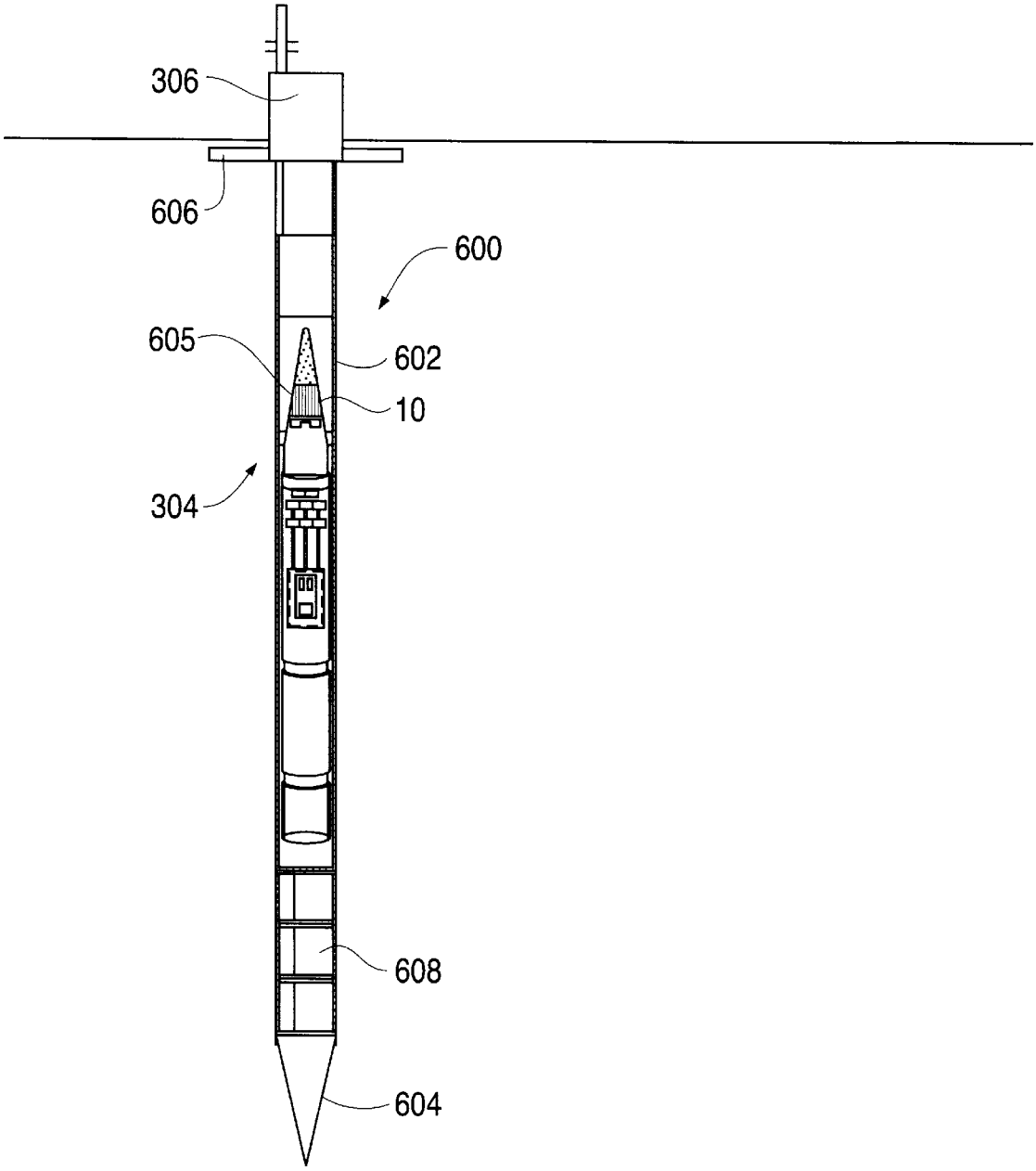
FIG. 6 illustrates a diagram of a guided missile launcher, penetrated into the ground, after air deployment in accordance with the present invention.

FIG. 6 illustrates a first embodiment 600 of a guided missile launcher 304 in accordance with the present invention. The guided missile may be, but is not limited to the guided missile of FIGS. 1 and 2 and is contained within at least one sleeve 602 which is metallic and has a wall thickness and a strength of material sufficient to withstand the deceleration forces of airborne deployment when striking the ground. As illustrated, a single sleeve 602 has a pointed tip 604 which causes the penetration of the guided missile launcher 304 into the ground up to the guidance fins 606 striking the ground which insures that the transceiver 306, including antenna, is above the ground to permit linking with the satellite 308. The sleeve contains a battery pack 608, which may contain lithium based batteries, having a high energy density and long shelf life. The interior opening of the sleeve 602 functions as a missile guide during launching. Because of the stopping of penetration of the guided missile launcher into the ground covered by the fins 606 striking the ground, there is a clear path permitting the missile 10 upon launch to travel upward within the interior of the sleeve 602 to permit a successful launch. The gases from ignition of the missile may be used to cause the transceiver 306 to be blown away permitting a free path to the atmosphere. Once the missile 10 is launched, it links via an internal GPS transceiver to the satellite 308 and to the control center 312 which contains one or more processors. Actual positional coordinates are generated by the internal GPS transceiver during flight which are transmitted to the control center 312. Furthermore, if for some reason the GPS telemetry between the missile 10 and the GPS satellites is jammed, the inertial guidance system in the missile 10 may totally control the flight path to the site of the time critical or moving target. Furthermore, if the GPS communications with satellites is not jammed, the GPS coordinates obtained during flight may be used to update the inertial guidance system of the missile 10 to further fine tune the flight of the guided missile to the correct coordinates for disabling the time critical target 400 or the moving target 402.

Figure 7:
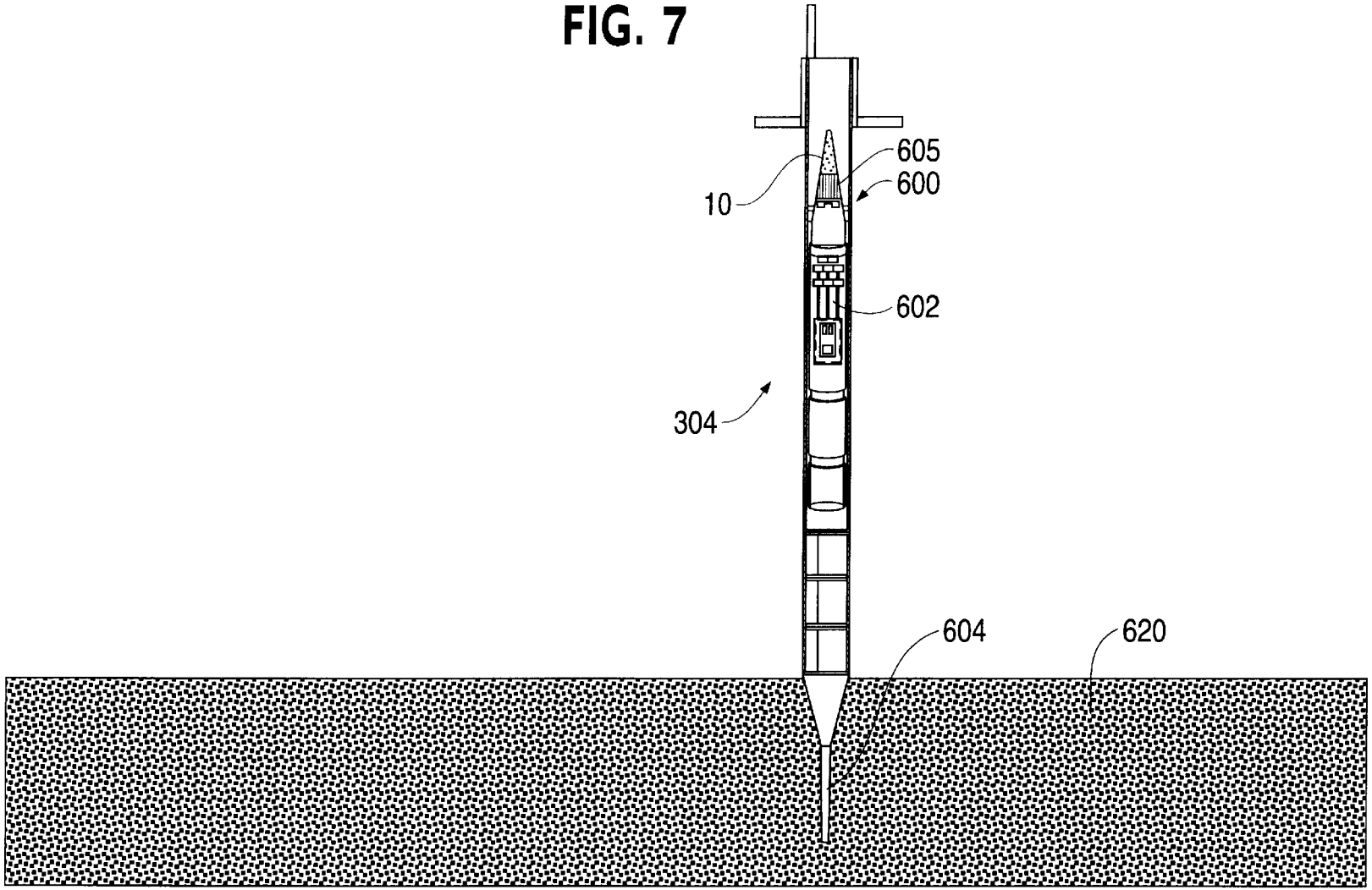
FIG. 7 illustrates a guided missile launcher, penetrated partially within rocky terrain, after air deployment in accordance with the present invention.

FIG. 7 illustrates the embodiment of FIG. 6 deployed in a rocky surface. In applications where rocky terrain is to be encountered, the tip 604 may be specifically designed to penetrate rocky terrain 620. Otherwise, operation is the same as described above with regard to FIG. 6.

Figure 8:
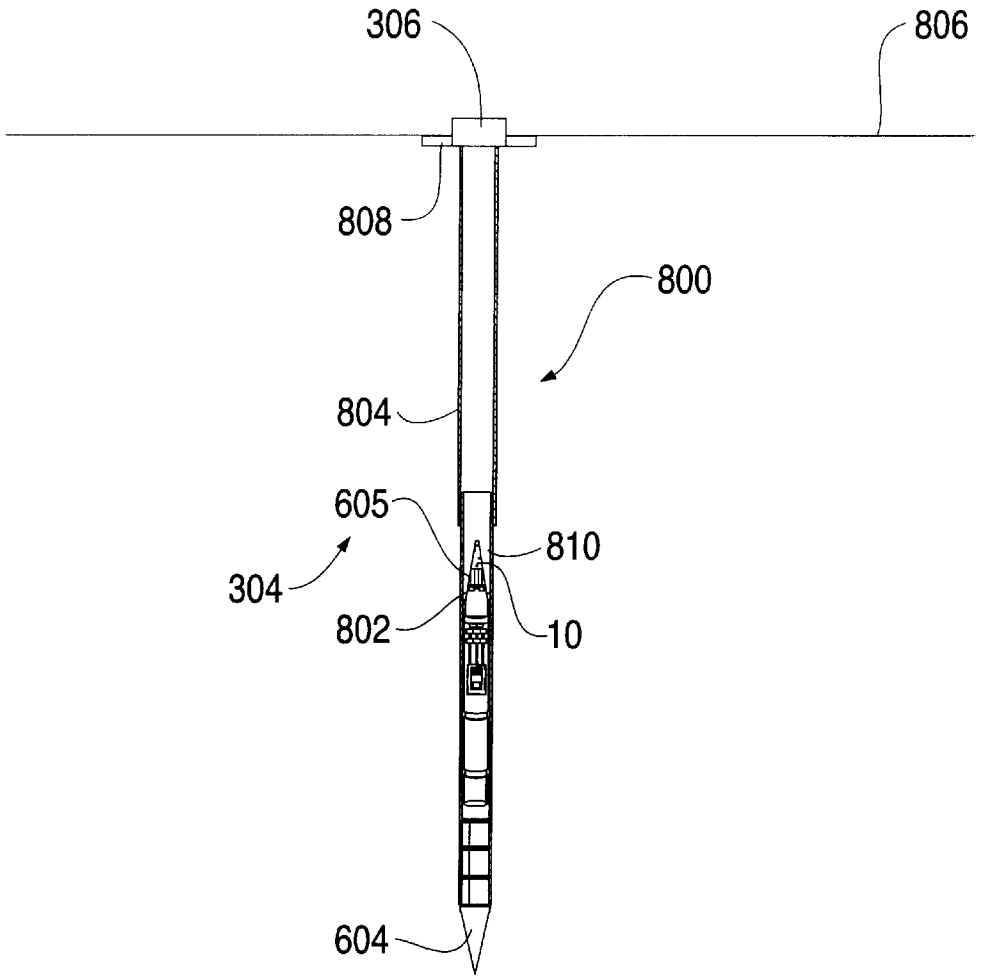
FIG. 8 illustrates a guided missile launcher, penetrated into the ground, having an inner and an outer sleeve, after air deployment in accordance with the present invention.

FIG. 8 illustrates a second embodiment 800 of a guided missile launcher having an inner sleeve 802 and an outer sleeve 804. The fins 808, which guide the missile launcher during free fall to point tip 604 downward to strike the ground 806 first stop penetration into the ground 806. The depth of penetration is controlled by the fins 808 so that the transceiver 306, including an antenna (not illustrated) is exposed above the ground. The inner sleeve 810 is mounted to telescope relative to the outer sleeve 804 which permits a greater ground penetration while at the same time providing the aforementioned opening above ground to facilitate successful launch of the guided missile 10. The wall thicknesses of the inner sleeve 802 and the outer sleeve 804 and the choice of materials used to manufacture the sleeves is chosen to withstand the deceleration forces which will be experienced by the guided missile launcher upon striking of the ground 806. Suitable stops (not illustrated) may be provided to limit the maximum telescoping of the inner sleeve 810.

Furthermore, while the at least one sleeve used to contain the guided missile 10 within the guided missile launcher is illustrated as being round, the present invention is not limited thereto. The sleeves may be triangular to have a smaller radar cross-section during air-drop.

Figure 9:
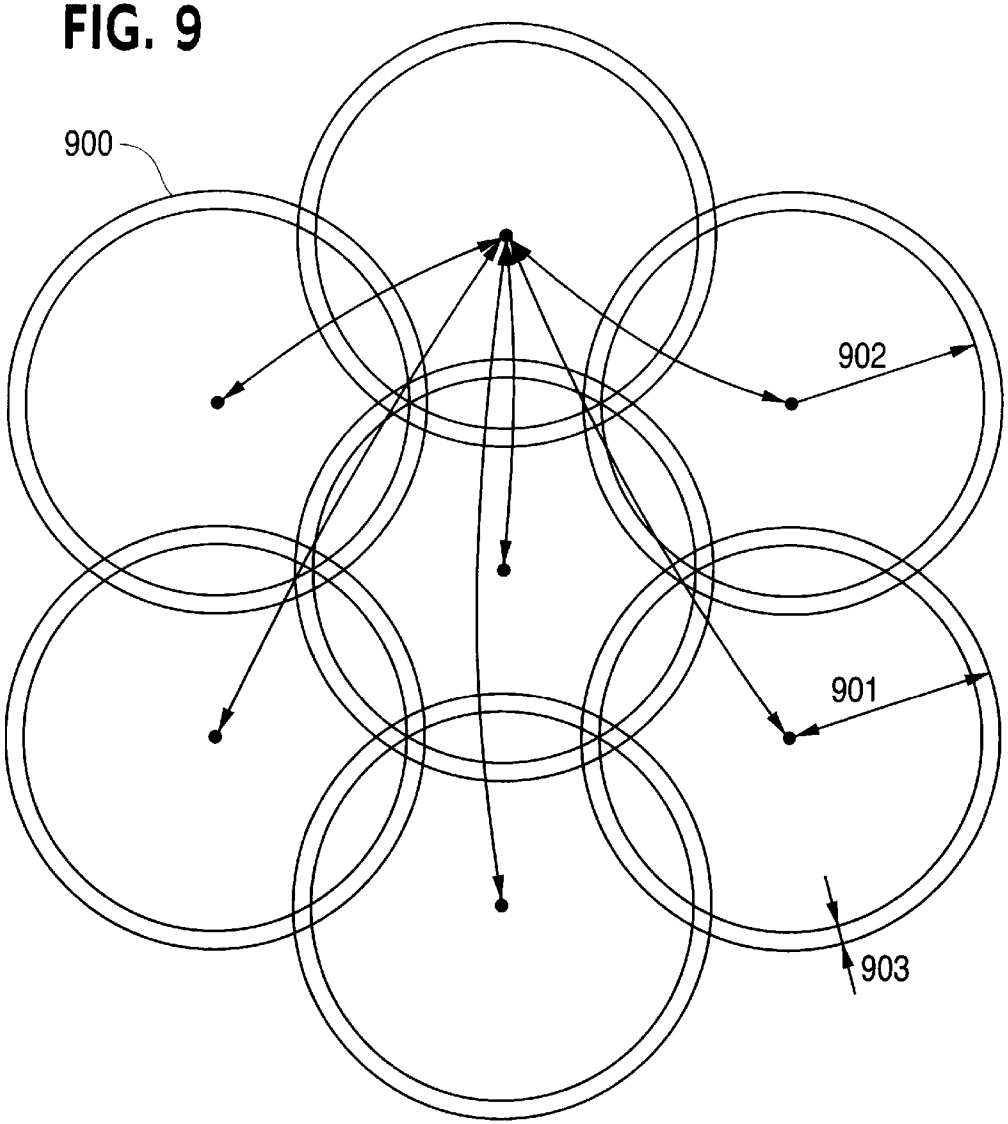
FIG. 9 illustrates a diagram of one possible deployment of guided missile launchers in accordance with the present invention which are in the pattern of a hexagon.

FIG. 9 illustrates one possible regular deployment pattern for guided missile launchers 304 in which individual guided missile launchers 304 are located at the corners of a hexagon which are determined by the centers of uniformly spaced circles 900 as illustrated. The radius of each circle 902 is the maximum missile range 901 minus the drop point error distance 903. A hexagonal deployment array of guided missile launchers 304 provides a high density of coverage but the present invention is not limited thereto and in view of the GPS positional telemetry provided within each guided missile launcher 304 by the transceiver 306, a totally arbitrary deployment of guided missile launchers 304 may be used in view of the command center 312 obtaining updated positional coordinates of all operational guided missile launchers on a real time basis.

While the invention has been described in terms of its preferred embodiments, it should be understood that numerous embodiments and numerous modifications may be made thereto without departing from the spirit and scope of the present invention. For example, as stated above, the present invention may be practiced with relative low cost ground sensors and guided missiles. While the use of existing components is desirable, it should be understood that the present invention is not limited thereto. It is intended that all such modifications fall within the scope of the appended claims.

What is claimed is:

1. A system for disabling a time critical target at a site within a geographical area comprising:

a plurality of ground contacting and spaced apart missile launchers located within or adjacent to the geographical area and disposed in a deployment pattern, each spaced apart mobile missile launcher containing a guided missile and being spaced apart along the ground so that the ground separates adjacent missile launchers, any site within the geographical area being located at a distance from at least one spaced apart missile launcher not more than a maximum distance of travel of a guided missile launched from at least one of the spaced apart missile launchers to the site, the time of travel of a missile from the missile launcher to the site requiring less time than a minimum time available to successfully enable the time critical target at the site; and an unmanned aircraft which illuminates the time critical target with a beam of light;

wherein the guided missile includes a sensor which senses reflection of the beam of light from the time critical target and guides, in response to the sensed reflection of the beam of light, the missile during flight to the time critical target.

2. A system for disabling a time critical target at a site within a geographical area comprising:

a plurality of ground contacting and spaced apart missile launchers located within or adjacent to the geographical area and disposed in a deployment pattern, each spaced apart mobile missile launcher containing a guided missile and being spaced apart along the ground so that the ground separates adjacent missile launchers, any site within the geographical area being located at a distance from at least one spaced apart missile launcher not more than a maximum distance of travel of a guided missile launched from at least one of the spaced apart missile launchers to the site, the time of travel of a missile from the missile launcher to the site requiring less time than a minimum time available to successfully enable the time critical target at the site;

wherein the spaced apart missile launchers each comprise a sleeve and a pointed end penetrated into ground at a site, the sleeve at least partially penetrating into the ground and containing the guided missile to be launched from the missile launcher;

wherein the spaced apart missile launchers each comprise an outer sleeve and an inner sleeve;

the inner sleeve contains the guided missile and is telescoped relative to the outer sleeve into the ground and contains a battery power unit which maintains the transceiver and the missile in an electrically powered status when embedded in ground;

the outer sleeve has a fin assembly located proximate to the transceiver;

and wherein the inner and outer sleeves are guidance paths for launching of the guided missile.

3. A system for disabling a time critical target at a site within a geographical area comprising:

a plurality of ground contacting and spaced apart missile launchers located within or adjacent to the geographical area and disposed in a deployment pattern, each spaced apart mobile missile launcher containing a guided missile and being spaced apart along the ground so that the ground separates adjacent missile launchers, any site within the geographical area being located at a distance from at least one spaced apart missile launcher not more than a maximum distance of travel of a guided missile launched from at least one of the spaced apart missile launchers to the site, the time of travel of a missile from the missile launcher to the site requiring less time than a minimum time available to successfully enable the time critical target at the site;

wherein the spaced apart missile launchers each comprise a sleeve and a pointed end penetrated into ground at a site, the sleeve at least partially penetrating into the ground and containing the guided missile to be launched from the missile launcher;

at least one sensor, the at least one sensor detecting a time critical target at least one site within the geographical area; and a command center, linked to the at least one sensor and to the plurality of spaced apart missile launchers, which commands launching of a guided missile from at least one of the spaced apart missile launchers to disable at least one time critical target at least one site detected by the at least one sensor;

wherein the spaced apart missile launchers each comprise an outer sleeve and an inner sleeve;

wherein the inner sleeve contains the guided missile and is telescoped relative to the outer sleeve into the ground and contains a battery power unit which maintains the transceiver and the missile in an electrically powered status when embedded in ground;

wherein the outer sleeve has a fin assembly located proximate to the transceiver;

and wherein the inner and outer sleeves are guidance paths for launching of the guided missile.

4. A system for disabling a time critical target at a site within a geographical area comprising:

a plurality of ground contacting and spaced apart missile launchers located within or adjacent to the geographical area and disposed in a deployment pattern, each spaced apart mobile missile launcher containing a guided missile and being spaced apart along the ground so that the ground separates adjacent missile launchers, any site within the geographical area being located at a distance from at least one spaced apart missile launcher not more than a maximum distance of travel of a guided missile launched from at least one of the spaced apart missile launchers to the site, the time of travel of a missile from the missile launcher to the site requiring less time than a minimum time available to successfully enable the time critical target at the site;

wherein the spaced apart missile launchers each comprise a sleeve and a pointed end penetrated into ground at a site, the sleeve at least partially penetrating into the ground and containing the guided missile to be launched from the missile launcher;

wherein the missile launchers located within the geographical area comprise a transceiver with at least an antenna disposed above the ground which transmits a radio signal indicating coordinates thereof within the geographical area and which receives commands for launching the guided missile to disable a time critical target at one site;

wherein the guided missile contained in the missile launchers contains a guidance system which controls flight of the guided missiles and which is in radio contact with the transceiver or a command center separated from the missile launchers to control flight thereof;

wherein the spaced apart missile launchers each comprise an outer sleeve and an inner sleeve;

wherein the inner sleeve contains the guided missile and is telescoped relative to the outer sleeve into the ground and contains a battery power unit which maintains the transceiver and the missile in an electrically powered status when embedded in ground;

wherein the outer sleeve has a fin assembly located proximate to the transceiver;

and wherein the inner and outer sleeves are guidance paths for launching of the guided missile.

5. A system for disabling a time critical target at a site within a geographical area comprising:

a plurality of ground contacting and spaced apart missile launchers located within or adjacent to the geographical area and disposed in a deployment pattern, each spaced apart mobile missile launcher containing a guided missile and being spaced apart along the ground so that the ground separates adjacent missile launchers, any site within the geographical area being located at a distance from at least one spaced apart missile launcher not more than a maximum distance of travel of a guided missile launched from at least one of the spaced apart missile launchers to the site, the time of travel of a missile from the missile launcher to the site requiring less time than a minimum time available to successfully enable the time critical target at the site;

wherein the spaced apart missile launchers each comprise a sleeve and a pointed end penetrated into ground at a site, the sleeve at least partially penetrating into the ground and containing the guided missile to be launched from the missile launcher;

at least one sensor, the at least one sensor detecting a time critical target at least one site within the geographical area; and a command center, linked to the at least one sensor and to the plurality of spaced apart missile launchers, which commands launching of a guided missile from at least one of the spaced apart missile launchers to disable at least one time critical target at least one site detected by the at least one sensor;

wherein the missile launchers located within the geographical area comprise a transceiver with at least an antenna disposed above the ground which transmits a radio signal indicating coordinates thereof within the geographical area and which receives commands for launching the guided missile to disable a time critical target at one site;

wherein the guided missile contained in the missile launchers contains a guidance system which controls flight of the guided missiles and which is in radio contact with the transceiver or a command center separated from the missile launchers to control flight thereof;

wherein the spaced apart missile launchers each comprise an outer sleeve and an inner sleeve;

wherein the inner sleeve contains the guided missile and is telescoped relative to the outer sleeve into the ground and contains a battery power unit which maintains the transceiver and the missile in an electrically powered status when embedded in ground;

wherein the outer sleeve has a fin assembly located proximate to the transceiver;

and wherein the inner and outer sleeves are guidance paths for launching of the guided missile.

6. A system for disabling a time critical target at a site within a geographical area comprising:

a plurality of ground contacting and spaced apart missile launchers located within or adjacent to the geographical area and disposed in a deployment pattern, each spaced apart mobile missile launcher containing a guided missile and being spaced apart along the ground so that the ground separates adjacent missile launchers, any site within the geographical area being located at a distance from at least one spaced apart missile launcher not more than a maximum distance of travel of a guided missile launched from at least one of the spaced apart missile launchers to the site, the time of travel of a missile from the missile launcher to the site requiring less time than a minimum time available to successfully enable the time critical target at the site;

wherein the spaced apart missile launchers each comprise a sleeve and a pointed end penetrated into ground at a site, the sleeve at least partially penetrating into the ground and containing the guided missile to be launched from the missile launcher;

wherein the spaced apart missile launchers each comprise an outer sleeve and an inner sleeve;

wherein the inner sleeve contains the guided missile and is telescoped relative to the outer sleeve into the ground and contains a battery power unit which maintains the transceiver and the missile in an electrically powered status when embedded in ground;

wherein the outer sleeve has a fin assembly located proximate to the transceiver;

wherein the inner and outer sleeves are guidance paths for launching of the guided missile; and the at least one sensor is in the ground within the geographical area.

7. A system for disabling a time critical target at a site within a geographical area comprising:

a plurality of ground contacting and spaced apart missile launchers located within or adjacent to the geographical area and disposed in a deployment pattern, each spaced apart mobile missile launcher containing a guided missile and being spaced apart along the ground so that the ground separates adjacent missile launchers, any site within the geographical area being located at a distance from at least one spaced apart missile launcher not more than a maximum distance of travel of a guided missile launched from at least one of the spaced apart missile launchers to the site, the time of travel of a missile from the missile launcher to the site requiring less time than a minimum time available to successfully enable the time critical target at the site;

wherein the spaced apart missile launchers each comprise a sleeve and a pointed end penetrated into ground at a site, the sleeve at least partially penetrating into the ground and containing the guided missile to be launched from the missile launcher;

wherein the spaced apart missile launchers each comprise an outer sleeve and an inner sleeve;

wherein the inner sleeve contains the guided missile and is telescoped relative to the outer sleeve into the ground and contains a battery power unit which maintains the transceiver and the missile in an electrically powered status when embedded in ground;

wherein the outer sleeve has a fin assembly located proximate to the transceiver;

wherein the inner and outer sleeves are guidance paths for launching of the guided missile;

and wherein the at least one sensor is in flight.

8. An air deployed guided missile assembly comprising:

a sleeve which is deployed from the air, the sleeve including a pointed end which penetrates the ground upon impact with the ground;

a guided missile contained within the sleeve with the sleeve guiding the guided missile during launch with the guided missile including a guidance system for guiding flight of the missile in a directed path to a target spaced from a site of the sleeve when penetrated into the ground; and a transceiver with at least an antenna disposed above the ground after impact which transmits a radio signal indicating coordinates of a location of the guided missile within a geographical area of deployment and which receives commands for launching the guided missile to fly to a site; and wherein the guided missile has a guidance system which controls flight of the guided missile and which is in radio contact with the transceiver or a command center separated from the deployed missile to control flight thereof.

9. An air deployed guided missile assembly comprising:

a sleeve which is deployed from the air, the sleeve including a pointed end which penetrates the ground upon impact with the ground;

a guided missile contained within the sleeve with the sleeve guiding the guided missile during launch with the guided missile including a guidance system for guiding flight of the missile in a directed path to a target spaced from a site of the sleeve when penetrated into the ground;

an outer sleeve and an inner sleeve containing the guided missile which is mounted to telescope relative to the outer sleeve and which telescopes upon impact with a ground contact point when deployed from the air; and a transceiver with at least an antenna disposed above the ground after impact which transmits a radio signal indicating coordinates of a location of the guided missile within the geographical area of deployment and which receives commands for launching the guided missile to fly to a site; and wherein the guided missile has a guidance system which controls flight of the guided missile and which is in radio contact with the transceiver or a command center separated from the deployed missile to control flight thereof.

10. An air deployed guided missile assembly comprising:

a sleeve which is deployed from the air, the sleeve including a pointed end which penetrates the ground upon impact with the ground;

a guided missile contained within the sleeve with the sleeve guiding the guided missile during launch with the guided missile including a guidance system for guiding flight of the missile in a directed path to a target spaced from a site of the sleeve when penetrated into the ground; and an outer sleeve and an inner sleeve containing the guided missile which is mounted to telescope relative to the outer sleeve and which telescopes upon impact with a ground contact point when deployed from the air;

wherein the inner sleeve is telescoped relative to the outer sleeve into the ground and contains a batter power unit which maintains the transceiver and the missile in an electrically powered status when embedded in the ground;

wherein the outer sleeve has a fin assembly located proximate to the transceiver when the pointed end penetrates into the ground;

and where the inner and outer sleeves are guidance paths for launching of the guided missile.

11. An air deployed guided missile assembly comprising:

a sleeve which is deployed from the air, the sleeve including a pointed end which penetrates the ground upon impact with the ground;

a guided missile contained within the sleeve with the sleeve guiding the guided missile during launch with the guided missile including a guidance system for guiding flight of the missile in a directed path to a target spaced from a site of the sleeve when penetrated into the ground;

an outer sleeve and an inner sleeve containing the guided missile which is mounted to telescope relative to the outer sleeve and which telescopes upon impact with a ground contact point when deployed from the air; and a transceiver with at least an antenna disposed above the ground after impact which transmits a radio signal indicating coordinates of a location of the guided missile within the geographical area of deployment and which receives commands for launching the guided missile to fly to a site;

wherein the guided missile has a guidance system which controls flight of the guided missile and which is in radio contact with the transceiver or a command center separated from the deployed missile to control flight thereof;

wherein the inner sleeve is telescoped relative to the outer sleeve into the ground and contains a batter power unit which maintains the transceiver and the missile in a powered status when embedded in the ground;

wherein the outer sleeve having a fin assembly located proximate to the transceiver when the pointed end penetrates into the ground;

and wherein the inner and outer sleeves are guidance paths for launching of the guided missile.

12. A system for disabling a moving target within a geographical area comprising:

a plurality of ground contacting and spaced apart missile launchers located within or adjacent to the geographical area and disposed in a deployment pattern, each spaced apart mobile missile launcher containing a guided missile and being spaced apart along the ground so that the ground separates adjacent missile launchers, any moving target within the geographical area being located at a distance from at least one spaced apart missile launcher not more than a maximum distance of travel of a guided missile launched from at least one of the spaced apart missile launchers to a calculated position within the geographical area at which at least one guided missile is to fly to disable the moving target;

at least one sensor, the at least one sensor detecting the moving target within the geographical area;

at least one processor for calculation of a site to which at least one guided missile is commanded to fly to disable the moving target;

a command center separated from the missile launchers, linked to the at least one sensor and to the plurality of spaced apart missile launchers, which commands launching of a guided missile from at least one of the spaced apart missile launchers to disable the moving target at site calculated by the at least one processor in response to the detected moving target detected by the at least one sensor; and an unmanned aircraft which illuminates the time critical target with a beam of light;

wherein the guided missile includes a sensor which senses reflection of the beam of light from the time critical target and guides, in response to the sensed reflection of the beam of light, the missile during flight to the time critical target.

13. A system for disabling a moving target within a geographical area comprising:

a plurality of ground contacting and spaced apart missile launchers located within or adjacent to the geographical area and disposed in a deployment pattern, each spaced apart mobile missile launcher containing a guided missile and being spaced apart along the ground so that the ground separates adjacent missile launchers, any moving target within the geographical area being located at a distance from at least one spaced apart missile launcher not more than a maximum distance of travel of a guided missile launched from at least one of the spaced apart missile launchers to a calculated position within the geographical area at which at least one guided missile is to fly to disable the moving target;

at least one sensor, the at least one sensor detecting the moving target within the geographical area;

at least one processor for calculation of a site to which at least one guided missile is commanded to fly to disable the moving target; and a command center separates from the missile launchers, linked to the at least one sensor and to the plurality of spaced apart missile launchers, which commands launching of a guided missile from at least one of the spaced apart missile launchers to disable the moving target at site calculated by the at least one processor in response to the detected moving target detected by the at least one sensor;

wherein the spaced apart missile launchers each comprise a sleeve and a pointed end penetrated into ground at a site, the sleeve at least partially penetrating into the ground and containing the guided missile to be launched from the missile launcher;

wherein the spaced apart missile launchers each comprise an outer sleeve and an inner sleeve;

wherein the inner sleeve contains the guided missile and is telescoped relative to the outer sleeve into the ground and contains a battery power unit which maintains the transceiver and the missile in an electrically powered status when embedded in ground;

wherein the outer sleeve has a fin assembly located proximate to the transceiver;

and wherein the inner and outer sleeves are guidance paths for launching of the guided missile.

14. A system for disabling a moving target within a geographical area comprising;

a plurality of ground contacting and spaced apart missile launchers located within or adjacent to the geographical area and disposed in a deployment pattern, each spaced apart mobile missile launcher containing a guided missile and being spaced apart along the ground so that the ground separates adjacent missile launchers, any moving target within the geographical area being located at a distance from at least one spaced apart missile launcher not more than a maximum distance of travel of a guided missile launched from at least one of the spaced apart missile launchers to a calculated position within the geographical area at which at least one guided missile is to fly to disable the moving target;

at least one sensor, the at least one sensor detecting the moving target within the geographical area;

at least one processor for calculation of a site to which at least one guided missile is commanded to fly to disable the moving target; and a command center separated from the missile launchers, linked to the at least one sensor and to the plurality of spaced apart missile launchers, which commands launching of a guided missile from at least one of the spaced apart missile launchers to disable the moving target at site calculated by the at least one processor in response to the detected moving target detected by the at least one sensor;

wherein the spaced apart missile launchers each comprise a sleeve and a pointed end penetrated into ground at a site, the sleeve at least partially penetrating into the ground and containing the guided missile to be launched from the missile launcher;

wherein the missile launchers located within the geographical area comprise a transceiver with at least an antenna disposed above the ground which transmits a radio signal indicating coordinates thereof within the geographical area and which receives commands for launching the guided missile to disable the moving target;

wherein the guided missiles contained in the missile launchers contain a guidance system which controls flight of the guided missiles and which is in radio contact with the transceiver or the command center to control flight thereof;

wherein the spaced apart missile launchers each comprise an outer sleeve and an inner sleeve;

wherein the inner sleeve contains the guided missile and is telescoped relative to the outer sleeve into the ground and contains a battery power unit which maintains the transceiver and the missile in an electrically powered status when embedded in ground;

wherein the outer sleeve has a fin assembly located proximate to the transceiver;

and wherein the inner and outer sleeves are guidance paths for launching of the guided missile.

15. A method for disabling a moving target within a geographical area comprising:

air deploying a plurality of ground contacting and spaced apart missile launchers located within or adjacent to the geographical area and disposed in a deployment pattern, each spaced apart mobile missile launcher containing a guided missile and being spaced apart along the ground so that the ground separates adjacent missile launchers, any moving target within the geographical area being located at a distance from at least one spaced apart missile launcher not more than a maximum distance of travel of a guided missile launched from at least one of the spaced apart missile launchers to a calculated position within the geographical area at which at least one guided missile is to fly to disable the moving target;

providing at least one sensor to detect the moving target;

detecting with the at least one sensor the moving target within the geographical area;

providing a command center, separated from and linked to the at least one sensor and to the plurality of spaced apart missile launchers;

using at least one processor to calculate a site to which the moving target is calculated to be moving and to which at least one guided missile is commanded to fly to disable the moving target;

commanding, with the command center, launching of at least one guided missile from at least one of the spaced apart missile launchers which is guided to a site calculated by the at least one processor in response to the detection of the moving target to disable the moving target at the site;

providing an unmanned aircraft which illuminates the time critical target with a beam of light; and providing the guided missile with a sensor which senses reflection of the beam of light from the time critical target and guiding, in response to the sensed reflection of the beam of light, the missile during flight to the time critical target.

* * * * *